US007168982B2

(12) United States Patent
Sakamoto

(10) Patent No.: US 7,168,982 B2
(45) Date of Patent: Jan. 30, 2007

(54) CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/315,199

(22) Filed: Dec. 23, 2005

(65) Prior Publication Data

US 2006/0141863 A1 Jun. 29, 2006

(30) Foreign Application Priority Data

Dec. 28, 2004 (JP) ..... P2004-379556

(51) Int. Cl.
*H01R 12/00* (2006.01)

(52) U.S. Cl. ..... 439/595

(58) Field of Classification Search ..... 439/595, 439/752, 752.5, 744
See application file for complete search history.

(56) References Cited

U.S. PATENT DOCUMENTS

| | | | | |
|---|---|---|---|---|
| 6,244,900 | B1 * | 6/2001 | Ishikawa et al. | 439/595 |
| 6,524,133 | B2 * | 2/2003 | Murakami | 439/595 |
| 6,669,507 | B2 * | 12/2003 | Yamanashi et al. | 439/595 |
| 7,014,505 | B1 * | 3/2006 | Tanaka et al. | 439/595 |
| 2005/0095911 | A1 * | 5/2005 | Mase et al. | 439/595 |
| 2006/0141863 | A1 * | 6/2006 | Sakamoto | 439/595 |

FOREIGN PATENT DOCUMENTS

| | | | |
|---|---|---|---|
| JP | 61-218081 | A | 9/1986 |
| JP | 2002-222672 | A | 8/2002 |
| JP | 2002-313472 | A | 10/2002 |
| JP | 2003-157925 | A | 5/2003 |
| JP | 2004-55466 | A | 2/2004 |

* cited by examiner

*Primary Examiner*—James R. Harvey
(74) *Attorney, Agent, or Firm*—Sughrue Mion, PLLC

(57) ABSTRACT

A connector includes a connector housing that includes a terminal receiving chamber for receiving a terminal, and an elastic retaining member that is arranged to retain an engagement portion of the terminal. The elastic retaining member includes a pair of ribs that are spaced from each other in a first direction perpendicular to a second direction in which the terminal is inserted, and a retaining portion that extends between the pair of ribs, and that is arranged to abut against the engagement portion of the terminal.

5 Claims, 4 Drawing Sheets

CONNECTOR

BACKGROUND OF THE INVENTION

This invention relates to a connector having an elastic retaining piece portion for retaining a terminal received in a terminal receiving chamber of a connector housing.

FIG. 4 and FIGS. 5 and 6 show known related connectors of the type described, respectively (see, for example, Patent Literature 1 and Patent Literature 2).

In the connector 101 shown in FIG. 4, a terminal receiving chamber 103 is formed in a synthetic resin-made connector housing 102, and extends from a central portion thereof to a rear end thereof. An elastic retaining piece portion 105 is formed in a cantilever manner within the terminal receiving chamber 103, and extends obliquely forwardly from an upper wall portion 102*a* of the connector housing 102.

When a terminal 108, connected to a wire 107, is inserted through a terminal insertion port 104 (formed in the rear end of the terminal receiving chamber 103) into the terminal receiving chamber 103, and is received therein, a free end (retaining portion) 106 of the elastic retaining piece portion 105 is retainingly engaged with a retaining engagement portion 109 of the terminal 108 to prevent the terminal 108 from withdrawal.

In the connector 201 shown in FIGS. 5 and 6, a terminal receiving chamber 202*a* is formed in a synthetic resin-made connector housing 202, and a terminal 203, formed by pressing an electrically-conductive metal sheet, is inserted into the terminal receiving chamber 202*a* through a rear opening thereof. The connector housing 202 has an elastic retaining piece portion 204 for retaining the terminal 203, received in the terminal receiving chamber 202*a*, to prevent the terminal 203 from withdrawal.

The terminal 203 includes an electrical contact portion 205 of a rectangular tubular shape into which a mating terminal (not shown) can be inserted to be electrically connected thereto, and a wire connection portion 206 which is provided at a rear side of the electrical contact portion 205, and can be electrically connected to a wire (not shown). A convex portion 207*a* is formed on an upper surface of a front end portion of the electrical contact portion 205.

A vertical retaining portion 207*b* is formed at a front end surface of the elastic retaining piece portion 204, and a rear end of the convex portion 207*a* of the terminal 203, received in the terminal receiving chamber 202*a*, abuts against this retaining portion 207*b*. A jig receiving portion 209*b* is also formed at the front end surface of the elastic retaining piece portion 204, and a jig can be brought into abutting engagement with this jig receiving portion 209*b* so as to cancel the retaining engagement of the elastic retaining piece portion with the terminal. The retaining portion 207*b* and the jig receiving portion 209*b* are disposed adjacent to each other in a direction of the width of the elastic retaining piece portion 204.

When the terminal 203 is inserted into the terminal receiving chamber 202*a* through the rear opening thereof, the terminal 203 advances within the terminal receiving chamber 202*a* while the convex portion 207*a* of the terminal 203 elastically deforms the elastic retaining piece portion 204 in a manner to displace the front end portion of this elastic retaining piece portion 204 upwardly. Then, when the front end of the terminal 203 is brought into abutting engagement with a front wall of the terminal receiving chamber 202*a*, the convex portion 207*a* of the terminal 203 slides past the elastic retaining piece portion 204, so that the elastic retaining piece portion 204 is restored into its original position. As a result, the retaining portion 207*b* of the elastic retaining piece portion 204 is retainingly engaged with the rear end of the convex portion 207*a* of the terminal 203, thereby preventing the terminal 203 from rearward withdrawal. For canceling the retaining engagement of the elastic retaining piece portion 204 with the terminal 203, the jig 209*a* is inserted into the terminal receiving chamber 202*a* from the front side, and is brought into abutting engagement with the slanting jig receiving portion 209*b*, and elastically deforms the elastic retaining piece portion 204 in a manner to displace the front end portion thereof upwardly, thereby canceling the retaining of the terminal 203 by the elastic retaining piece portion 204.

[Patent Literature 1] JP-A-61-218081

[Patent Literature 2] JP-A-2002-313472

In each of the above related connectors 101 and 201, however, the metal-made terminals 103, 203 (the convex portion 207*a*) abuts against the retaining portions 106, 207*b* of the synthetic resin-made elastic retaining piece portions 105, 204, and therefore there is a fear that the retaining portions 106, 207*b* are worn, so that the force of retaining of the terminals 103, 203 by the elastic retaining piece portions 105, 204 is lowered.

And besides, when the terminals are arranged at a small pitch in order to meet a requirement of a compact design of recent connectors, the elastic retaining piece portions 105, 204 become narrow, and therefore there is a fear that the strength of the elastic retaining piece portions 105, 204 is lowered. For example, in the related connector 101, the elastic retaining piece portion 105 is liable to be buckled as shown in FIG. 7, and therefore there is a fear that the force of retaining of the terminals 103, 203 by the elastic retaining piece portions 105, 204 is lowered.

Therefore, in the related connector 201, a pair of projecting portions 208*b* are formed on and project laterally outwardly respectively from the opposite side surfaces of the elastic retaining piece portion 204 (as shown in FIG. 6) in order to enhance the force of retaining of the terminal 203 by the elastic retaining piece portion 204. The pair of projecting portions 208*b* retain engagement portions 208*a*, formed at the rear end of the electrical contact portion 205, respectively, thereby preventing the rearward withdrawal of the terminal 203 in a double manner. However, as a result of formation of the projecting portions 208*b*, the width of the elastic retaining piece portion 204 increases, and therefore there has been a fear that the achievement of a compact design of the connector 201 is adversely affected.

And besides, when the connector is formed into a compact design, the jig 209*a* for canceling the retaining engagement of the elastic retaining piece portion 204 with the terminal 203 also becomes narrow, and therefore there has been a fear that the jig 209*a* fails to be positively engaged with (or abut against) the jig receiving portion 209*b* defined by a flat surface.

SUMMARY OF THE INVENTION

This invention has been made in order to solve the above problems, and an object of the invention is to provide a connector in which a sufficient terminal-retaining force is obtained without increasing a width of a retaining lance, and also the strength of the retaining lance is increased so as to achieve a compact design of the connector.

The above object has been achieved by a connector of the present invention comprising a terminal, and a connector housing which includes a terminal receiving chamber having the terminal inserted therein, and an elastic retaining piece portion for retaining engagement with a retaining engagement portion of the terminal, received in the terminal receiving chamber, to prevent the terminal from withdrawal; characterized in that the elastic retaining piece portion includes a pair of ribs which are formed in an upstanding manner, and are spaced from each other in a direction perpendicular to a direction of withdrawing of the terminal, and a retaining portion which extends between the pair of ribs and against which the retaining engagement portion of the terminal abuts in the withdrawing direction; and those end edges of the pair of ribs, disposed close to the retaining engagement portion, project beyond the retaining portion in a direction toward the retaining engagement portion.

Preferably, the pair of ribs extend in the direction of withdrawing of the terminal.

Preferably, a jig for elastically deforming the elastic retaining piece portion so as to cancel the retaining engagement of the retaining piece portion with the terminal can be brought into engagement with the elastic retaining piece portion at a region between the pair of ribs; and the end edges of the pair of ribs serve as a guide portion for guiding the jig into a gap between the pair of ribs.

In the present invention, the elastic retaining piece portion includes the pair of ribs which are formed in an upstanding manner, and are spaced from each other in the direction perpendicular to the direction of withdrawing of the terminal, and the retaining portion which extends between the pair of ribs and against which the retaining engagement portion of the terminal abuts in the withdrawing direction, and the end edges of the pair of ribs, disposed close to the retaining engagement portion, project forwardly beyond the retaining portion. Namely, that portion of the elastic retaining piece portion for receiving the retaining engagement portion of the terminal is formed into a generally U-shape by the retaining portion and the pair of ribs formed integrally with the retaining portion. With this construction, a shearing strength of the retaining portion can be enhanced, and therefore wear of the elastic retaining piece portion, developing upon abutment against the retaining engagement portion of the terminal, is suppressed, thereby securing the sufficient force of retaining of the terminal by the elastic retaining piece portion.

The pair of ribs are formed in an upstanding manner on the elastic retaining piece portion, and are spaced from each other in the direction perpendicular to the direction of withdrawing of the terminal. Namely, the pair of ribs do not project from the elastic retaining piece portion in the direction of the width thereof, and therefore the width of the elastic retaining piece portion can be reduced, thereby achieving a compact design of the connector.

With the elastic retaining piece portion of this simplified structure, the sufficient terminal-retaining force can be obtained, and besides the compact design of the connector can be achieved.

Furthermore, since the pair of ribs extend in the direction of withdrawing of the terminal, even the narrow elastic retaining piece portion can have a sufficient buckling strength, and therefore the terminal-retaining force of the elastic retaining piece portion can be further enhanced.

Furthermore, the jig for elastically deforming the elastic retaining piece portion so as to cancel the retaining engagement of the elastic retaining piece portion with the terminal is brought into engagement with the elastic retaining piece portion at the region between the pair of ribs, and the end edges of the pair of ribs serve as the guide portion for guiding the jig into the gap between the pair of ribs. With this construction, the portion of the elastic retaining piece portion with which the jig can be engaged is formed into a generally U-shape by the pair of ribs and the retaining portion, and the jig is guided by the pair of ribs (forming this engaging portion), and therefore the jig can be positively brought into engagement with the elastic retaining piece portion.

According to the present invention, there is also provided a connector, comprising:

a connector housing that includes a terminal receiving chamber for receiving a terminal; and an elastic retaining member that is arranged to retain an engagement portion of the terminal, wherein the elastic retaining member includes:

a pair of ribs that are arranged to be spaced from each other in a first direction perpendicular to a second direction in which the terminal is inserted; and a retaining portion that extends between the pair of ribs, and that is arranged to abut against the engagement portion of the terminal.

Preferably, the pair of ribs includes edge portions that are disposed close to the engagement portion of the terminal. The edge portions project beyond the retaining portion in the second direction toward the engagement portion of the terminal.

Preferably, the pair of ribs extend in the second.

Preferably, a jig receiving portion is formed at a region on the elastic retaining member surrounded by the edge portions and the retaining portion. The jig receiving portion is arranged to receive a jig for elastically deforming the elastic retaining member so as to cancel the engagement of the elastic retaining member with the terminal. The edge portions of the ribs guides the jig into the jig receiving portion.

Preferably, the connector housing includes an upper wall having grooves and side walls. The elastic retaining member is provided on the upper wall. A part of the upper wall, on which the elastic retaining member is provided, is separated from the side walls by the grooves.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of a connector of the present invention will now be described with reference to the drawings.

Figure 1:
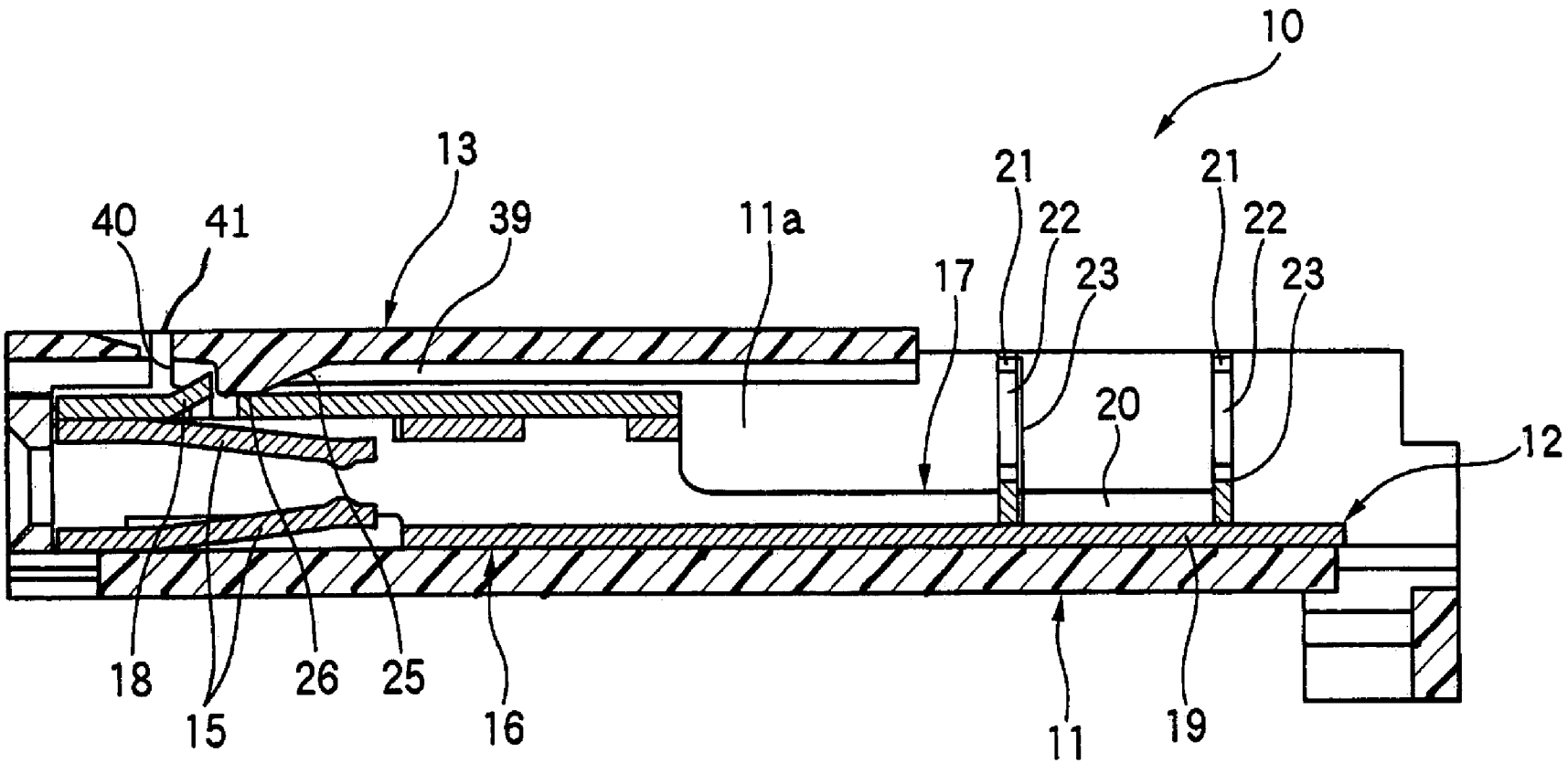
FIG. 1 is a cross-sectional view explanatory of one preferred embodiment of a connector of the present invention.
Figure 2:
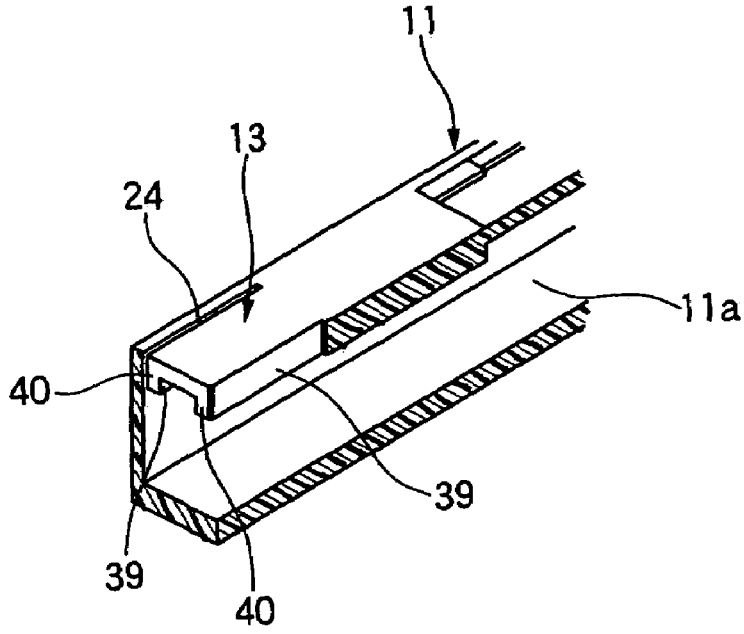
FIG. 2 is a partly-broken, perspective view of a connector housing of the connector of FIG. 1, showing an elastic retaining piece portion of the connector.
Figure 3:
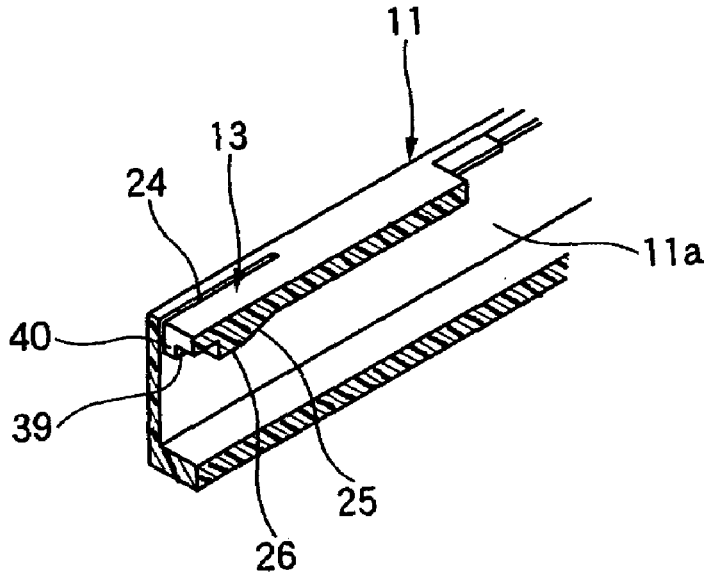
FIG. 3 is a perspective view, showing a condition in which the elastic retaining piece portion of FIG. 2 is broken along a direction of withdrawing of a terminal.
Figure 4:
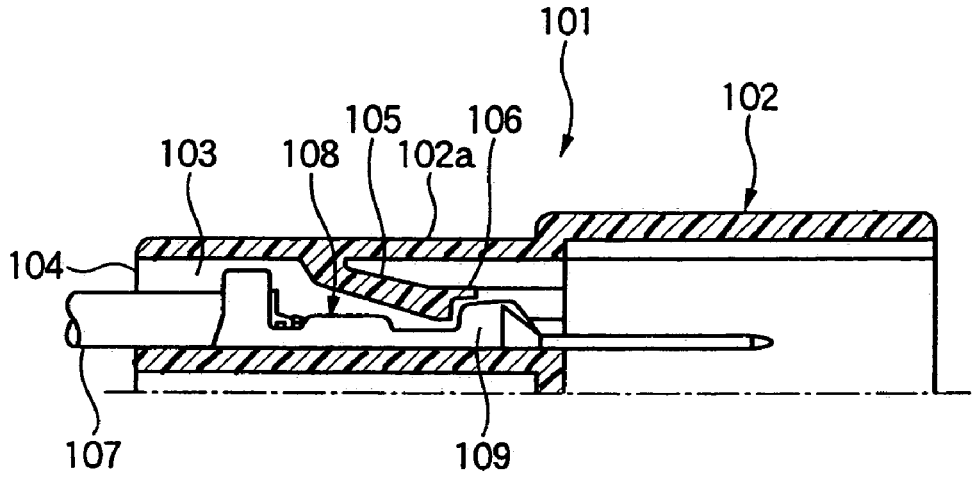
RELATED ART FIG. 4
FIG. 4 is a cross-sectional view of a related connector.
Figure 5:
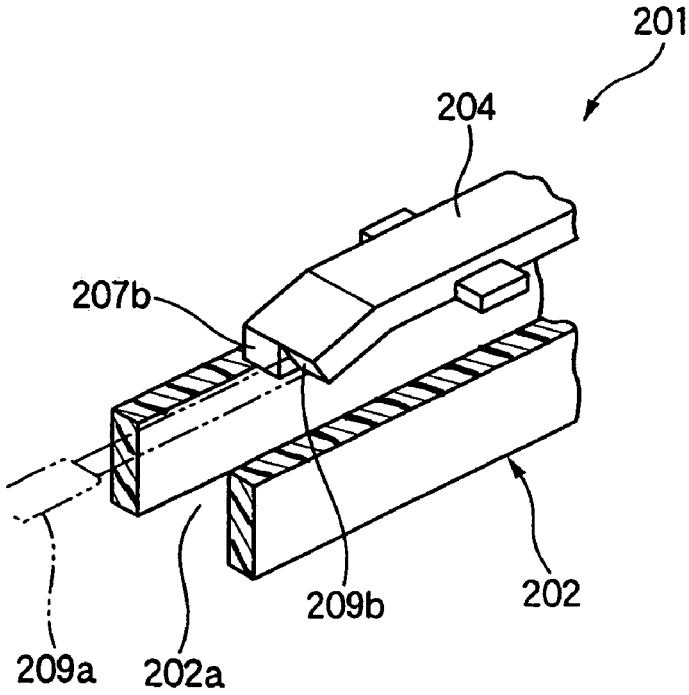
RELATED ART FIG. 5
FIG. 5 is a partly-broken, perspective view of a connector housing of another related connector.
Figure 6:
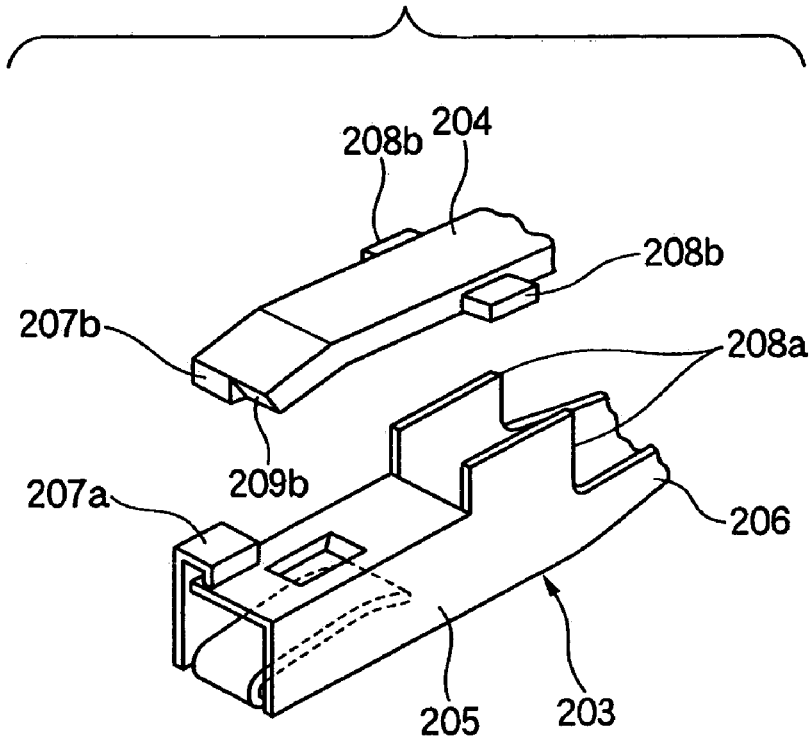
RELATED ART FIG. 6
FIG. 6 is a perspective view showing an elastic retaining piece portion of the connector of FIG. 5 and a terminal.
Figure 7:
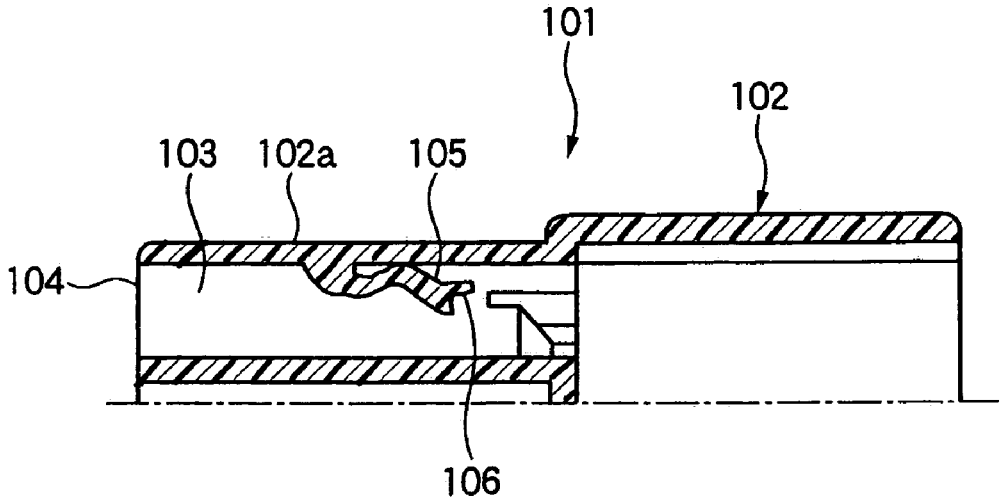
FIG. 7 RELATED ART
FIG. 7 is a cross-sectional view showing a condition in which an elastic retaining piece portion of the connector of FIG. 4 is buckled.

FIG. 1 is a cross-sectional view explanatory of one preferred embodiment of the connector of the invention, FIG. 2 is a partly-broken, perspective view of a connector housing of the connector of FIG. 1, showing an elastic retaining piece portion of the connector, and FIG. 3 is a perspective view, showing a condition in which the elastic retaining piece portion of FIG. 2 is broken along a direction of withdrawing of a terminal.

As shown in FIG. 1, the connector 10 of this embodiment includes the synthetic resin-made connector housing 11 having a terminal receiving chamber 11*a*, and the terminal 12 (which is formed by pressing an electrically-conductive metal sheet) is inserted into the terminal receiving chamber 11*a* through a rear opening thereof. The retaining lance (elastic retaining piece portion) 13 for retaining the terminal 12 received in the terminal receiving chamber 11*a* is formed integrally on the connector housing 11.

The terminal 12 to be received in the terminal receiving chamber 11*a* includes an electrical contact portion 16 of a generally rectangular tubular shape formed at a front end portion thereof, and a wire press-contacting portion 17 formed at a rear end portion thereof. A spring piece portion 15 is provided within the electrical contact portion 16, and a mating terminal (not shown), when inserted into the electrical contact portion 16, is electrically connected to the spring piece portion 15. A projecting piece portion 18 (serving as a retaining engagement portion) for being retained by the retaining lance 13 extends obliquely upwardly from a widthwise-central portion of a front end portion of an upper wall of the electrical contact portion 16 toward the rear end thereof.

The wire connection portion 17 includes a base plate portion 19 extending horizontally from the electrical contact portion 16, a pair of vertical side walls 20 which are bent at and project upwardly respectively from widthwise-opposite sides of the base plate portion 19, and press-contacting piece portions 23 each including a wire press-contacting slot portion 22 having a blade 21 for cutting an insulating sheath of a sheathed wire (not shown) so that the slot portion 22 can be brought into electrical contact with an internal conductor of the sheathed wire.

When the sheathed wire is press-fitted into the slot portion 22 of each press-contacting piece portion 23 of the terminal 12 from the upper side, the insulating sheath of the sheathed wire is cut by the blade 21 of the slot portion 22, so that the internal conductor of the sheathed wire contacts the press-contacting piece portion 23. As a result, the internal conductor of the sheathed wire is electrically connected to the terminal 12, and also the sheathed wire is held by the press-contacting piece portions 23. In this condition, the terminal 12 is inserted into the terminal receiving chamber 11*a* through the rear (right in FIG. 1) opening thereof, and also the terminal 12 can be withdrawn from the terminal receiving chamber 11*a*.

The retaining lance 13 is formed integrally with a front end portion of an upper wall (forming part of the terminal receiving chamber 11*a*) of the connector housing 11. As shown in FIGS. 2 and 3, a slit 24 of a generally U-shape is formed in the front end portion of the upper wall of the connector housing 11, and by doing so, the retaining lance 13 is supported in a cantilever manner at its rear end on the connector housing 11, and extends forwardly, and therefore this retaining lance 13 can be elastically deformed in such a manner that its front end portion is displaced upward and downward.

As shown in FIGS. 1 and 2, a pair of ribs 39 are formed respectively on opposite side edge portions of a lower surface (facing the terminal 12 received in the terminal receiving chamber 11*a*) of the retaining lance 13, and project toward the terminal 12, and extend from the front end of the retaining lance 13 to the rear end thereof. Namely, the pair of ribs 39 are formed in an upstanding manner, and are spaced from each other in a direction perpendicular to the direction of withdrawing of the terminal 12, and extend in the direction of withdrawing of the terminal 12.

As shown in FIGS. 1 and 3, a retaining portion 26 is formed integrally on a front end portion of the lower surface of the retaining lance 13, and interconnects the pair of ribs 39. Namely, the retaining portion 26 extends between the pair of ribs 39. When the terminal 12, received in the terminal receiving chamber 11*a*, is moved in the withdrawing direction, the projecting piece portion 18 of the terminal 12 abuts against the retaining portion 26, thereby preventing the withdrawal of the terminal 12.

Front end edges 40 of the pair of ribs 39 project forwardly beyond the retaining portion 26, and therefore that portion of the retaining lance 13 for receiving the projecting piece portion 18 of the terminal 12 is formed into a generally U-shape as a whole. A rear end surface of the retaining portion 26 is formed as a slanting surface 25 which is slanting forwardly downwardly.

Next, the retaining of the terminal 12 by the retaining lance 13 of the connector housing 11 will be described.

The terminal 12 with which the sheathed wire is press-contacted as described above is inserted into the terminal receiving chamber 11*a* through the rear opening thereof. During the insertion of the terminal 12, the projecting piece portion 18 (formed at the electrical contact portion 16 of the terminal 12), while guided by the pair of ribs 39, advances along a region between the pair of ribs 39, and is brought into abutting engagement with the slanting surface 25 formed at the rear end of the retaining portion 26 of the retaining lance 13, and further slides forward along the slanting surface 25 of the retaining lance 13, while elastically deforming the retaining lance 13 in a manner to displace the front end portion thereof upwardly. Then, when the terminal 12 is inserted into a position where the front end of the electrical contact portion 16 abuts against a front wall of the terminal receiving chamber 11*a*, the retaining lance 13 is restored from the elastically-deformed condition into the original condition, so that the retaining portion 26 of the retaining lance 13 becomes engaged with the rear end of the projecting piece portion 18. When the terminal 12, received in the terminal receiving chamber 11*a*, is moved rearward so as to be withdrawn, the rear end of the projecting piece portion 18 of the terminal 12 abuts against the retaining portion 26, thereby preventing the rearward withdrawal of the terminal 12.

For canceling the retaining engagement of the retaining portion 26 of the retaining lance 13 with the projecting piece portion 18 of the terminal 12, a jig is inserted through a front opening of the terminal receiving chamber 11*a* into a gap ("jig receiving portion") 41 between the upper wall of the connector housing 11 (forming part of the terminal receiving chamber 11*a*) and the upper wall of the electrical contact portion 16 of the terminal 12. A distal end of the jig, while guided by the front end edges 40 of the pair of ribs 39, is inserted between the front end edges 40 of the pair of ribs 39, and is brought into engagement with the retaining lance 13, and elastically deforms the retaining lance 13 in a manner to displace the front end of this retaining lance upwardly. As a result, the retaining of the projecting piece portion 18 of the terminal 12 by the retaining portion 26 of the retaining lance is canceled. That portion of the retaining lance 13 with which the jig is brought into engagement is formed into a generally U-shape by the pair of ribs 39 and the retaining portion 26, and the jig is guided by the pair of ribs 39 (forming this engaging portion), and therefore the jig can be positively brought into engagement with the retaining lance 13.

In the connector 10 of this embodiment, the retaining lance 13 includes the pair of ribs 39 which are formed in an upstanding manner, and are spaced from each other in the direction perpendicular to the direction of withdrawing of the terminal, and the retaining portion 26 which extends between the pair of ribs 39 and against which the projecting piece portion 18 of the terminal 12 abuts in the withdrawing direction, and the front end edges 40 of the pair of ribs 39 project forwardly beyond the retaining portion 26. Namely, the portion of the retaining lance 13 for receiving the projecting piece portion 18 of the terminal 12 is formed into a generally U-shape by the retaining portion 26 and the pair of ribs 39 formed integrally with the retaining portion 26. With this construction, the shearing strength of the retaining portion 26 can be enhanced, and therefore wear of the retaining lance 13, developing upon abutment against the projecting piece portion 18 of the terminal 12, is suppressed, thereby securing the sufficient force of retaining of the terminal by the retaining lance 13.

The pair of ribs 39 are formed in an upstanding manner on the retaining lance 13, and are spaced from each other in the direction perpendicular to the direction of withdrawing of the terminal 12. Namely, the pair of ribs 39 do not project from the retaining lance 13 in the direction of the width thereof, and therefore the width of the retaining lance 13 can be reduced, thereby achieving the compact design of the connector 10.

With the retaining lance 13 of this simplified structure, the sufficient terminal-retaining force of the retaining lance 13 can be obtained, and besides the compact design of the connector 10 can be achieved.

Furthermore, since the pair of ribs 39 extend in the direction of withdrawing of the terminal 12, even the narrow retaining lance 13 can have a sufficient buckling strength, and therefore the terminal-retaining force of the retaining lance 13 can be further enhanced.

Furthermore, the jig for elastically deforming the retaining lance 13 so as to cancel the retaining engagement of the retaining lance 13 with the terminal 12 is brought into engagement with the retaining lance 13 at the region between the pair of ribs 39, and the front end edges 40 of the pair of ribs 39 serve as a guide portion for guiding the jig into the gap between the pair of ribs 39. With this construction, the portion of the retaining lance 13 with which the jig can be engaged is formed into a generally U-shape by the pair of ribs 39 and the retaining portion 26, and the jig is guided by the pair of ribs 39 (forming this engaging portion), and therefore the jig can be positively brought into engagement with the retaining lance 13.

The present invention is not limited to the above embodiment, and suitable modifications can be made without departing from the subject matter of the invention.

The present application is based on Japan Patent Application No. 2004-379556 filed on Dec. 28, 2005, the contents of which are incorporated herein for reference.

What is claimed is:

1. A connector, comprising:

a connector housing that includes a terminal receiving chamber for receiving a terminal; and an elastic retaining member that is arranged to retain an engagement portion of the terminal, wherein the elastic retaining member includes:

a pair of ribs that are arranged to be spaced from each other in a first direction perpendicular to a second direction in which the terminal is inserted and project in a third direction perpendicular to both the first and second directions; and a retaining portion that extends between the pair of ribs, and that is arranged to abut against the engagement portion of the terminal.

2. The connector according to claim 1, wherein the pair of ribs includes edge portions that are disposed close to the engagement portion of the terminal; and wherein the edge portions project beyond the retaining portion in the second direction toward the engagement portion of the terminal.

3. The connector according to claim 1, wherein the pair of ribs extend in the second direction.

4. The connector according to claim 2, wherein a jig receiving portion is formed at a region on the elastic retaining member surrounded by the edge portions and the retaining portion;

wherein the jig receiving portion is arranged to receive a jig for elastically deforming the elastic retaining member so as to cancel the engagement of the elastic retaining member with the terminal; and wherein the edge portions of the ribs guides the jig into the jig receiving portion.

5. The connector according to claim 1, wherein the connector housing includes an upper wall having grooves and side walls;

wherein the elastic retaining member is provided on the upper wall; and wherein a part of the upper wall, on which the elastic retaining member is provided, is separated from the side walls by the grooves.

* * * * *